US008960328B2

(12) United States Patent
Herberg et al.

(10) Patent No.: US 8,960,328 B2
(45) Date of Patent: Feb. 24, 2015

(54) DRILL BIT WITH ADJUSTABLE SIDE FORCE

(75) Inventors: Wolfgang E. Herberg, Niedersachsen (DE); Matthias Meister, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 182 days.

(21) Appl. No.: 13/222,170

(22) Filed: Aug. 31, 2011

(65) Prior Publication Data

US 2012/0055713 A1 Mar. 8, 2012

Related U.S. Application Data

(60) Provisional application No. 61/378,771, filed on Aug. 31, 2010.

(51) Int. Cl.

| | |
|---|---|
| ***E21B 7/00*** | (2006.01) |
| ***E21B 47/12*** | (2012.01) |
| ***E21B 7/06*** | (2006.01) |
| ***E21B 10/26*** | (2006.01) |

(52) U.S. Cl.

CPC . *E21B 47/12* (2013.01); *E21B 7/06* (2013.01); *E21B 7/064* (2013.01); *E21B 7/067* (2013.01); *E21B 10/26* (2013.01)

USPC ..... 175/57; 175/352

(58) Field of Classification Search

CPC ..... E21B 10/086; E21B 10/26; E21B 44/005; E21B 44/04; E21B 7/06; E21B 7/064; E21B 7/067

USPC ..... 175/61, 342, 352, 371, 372, 173, 92, 175/57, 27, 106, 73, 341, 108, 414, 306; 76/108.4

See application file for complete search history.

(56) References Cited

U.S. PATENT DOCUMENTS

| | | | | |
|---|---|---|---|---|
| 4,932,484 | A * | 6/1990 | Warren et al. | 175/431 |
| 5,845,721 | A | 12/1998 | Southard | |
| 7,207,398 | B2 * | 4/2007 | Runia et al. | 175/61 |
| 7,562,725 | B1 * | 7/2009 | Broussard et al. | 175/93 |
| 7,610,970 | B2 * | 11/2009 | Sihler et al. | 175/61 |
| 8,333,254 | B2 * | 12/2012 | Hall et al. | 175/61 |
| 2009/0321136 | A1 | 12/2009 | Southard | |
| 2011/0220417 | A1 * | 9/2011 | Pafitis et al. | 175/61 |
| 2012/0080234 | A1 * | 4/2012 | Hall et al. | 175/61 |

OTHER PUBLICATIONS

"Adjust"—definition; thefreedictionary.com, Jul. 21, 2014.*

International Search Report and the Written Opinion of the International Searching Authority for International Application No. PCT/US2011/049913; all references are cited above.

* cited by examiner

*Primary Examiner* — Jennifer H Gay
*Assistant Examiner* — George Gray
(74) *Attorney, Agent, or Firm* — Cantor Colburn LLP

(57) ABSTRACT

A drill bit is disclosed. The drill bit includes a center member configured to rotate at a first speed and an outer member disposed outside the center member, wherein the outer member is configured to rotate at a second speed. The drill bit also includes a first cutter disposed on the center member and a second cutter disposed on the outer member, wherein the first speed and second speeds are configured to control a resultant side force of the drill bit.

16 Claims, 7 Drawing Sheets

DRILL BIT WITH ADJUSTABLE SIDE FORCE

CROSS-REFERENCE TO RELATED APPLICATION

This application takes priority from U.S. Provisional application Ser. No. 61/378,771, filed on Aug. 31, 2010, which is incorporated herein in its entirety by reference.

BACKGROUND

1. Field of the Disclosure

This disclosure relates generally to drill bits and systems for using same for drilling wellbores.

2. Background of the Art

Oil wells (also referred to as wellbores or boreholes) are drilled with a drill string that includes a tubular member having a drilling assembly (also referred to as the drilling assembly or bottomhole assembly or "BHA") which includes a drill bit attached to the bottom end thereof. The drill bit is rotated to disintegrate the rock formation to drill the wellbore. The BHA includes devices and sensors for providing information about a variety of parameters relating to the drilling operations (drilling parameters), the behavior of the BHA (BHA parameters) and the formation surrounding the wellbore being drilled (formation parameters). A large number of wellbores are drilled along a contoured trajectory. For example, a single wellbore may include one or more vertical sections, deviated sections and horizontal sections. Some BHAs include adjustable knuckle joints to form a deviated wellbore or elements such as arms or paddles on a rotary steerable drilling system for directional control. Such steering devices are typically disposed on the BHA, i.e., away from the drill bit. However, it is desirable to have steering devices that are close to or on the drill bit to effect steering, improve rate of penetration of the drill bit and/or to extend the drill bit life. Further, it is desirable to have a mechanism on the bit to effect steering that has few components and moving parts to improve reliability and reduce downtime.

SUMMARY

A drill bit according to one embodiment includes a center member configured to rotate at a first speed and an outer member disposed outside the center member, wherein the outer member is configured to rotate at a second speed. The drill bit also includes a first cutter disposed on the center member and a second cutter disposed on the outer member, wherein the first speed and second speeds are configured to control a resultant side force of the drill bit.

A method for making a drill bit according to one aspect includes providing a center bit configured to rotate at a first speed; and providing an outer bit disposed outside the center bit, wherein the outer bit is configured to rotate at a second speed, wherein the first speed and second speeds are configured to control a resultant side force of the drill bit.

The disclosure, in one aspect, provides examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DETAILED DESCRIPTION OF THE EMBODIMENTS

Figure 1:
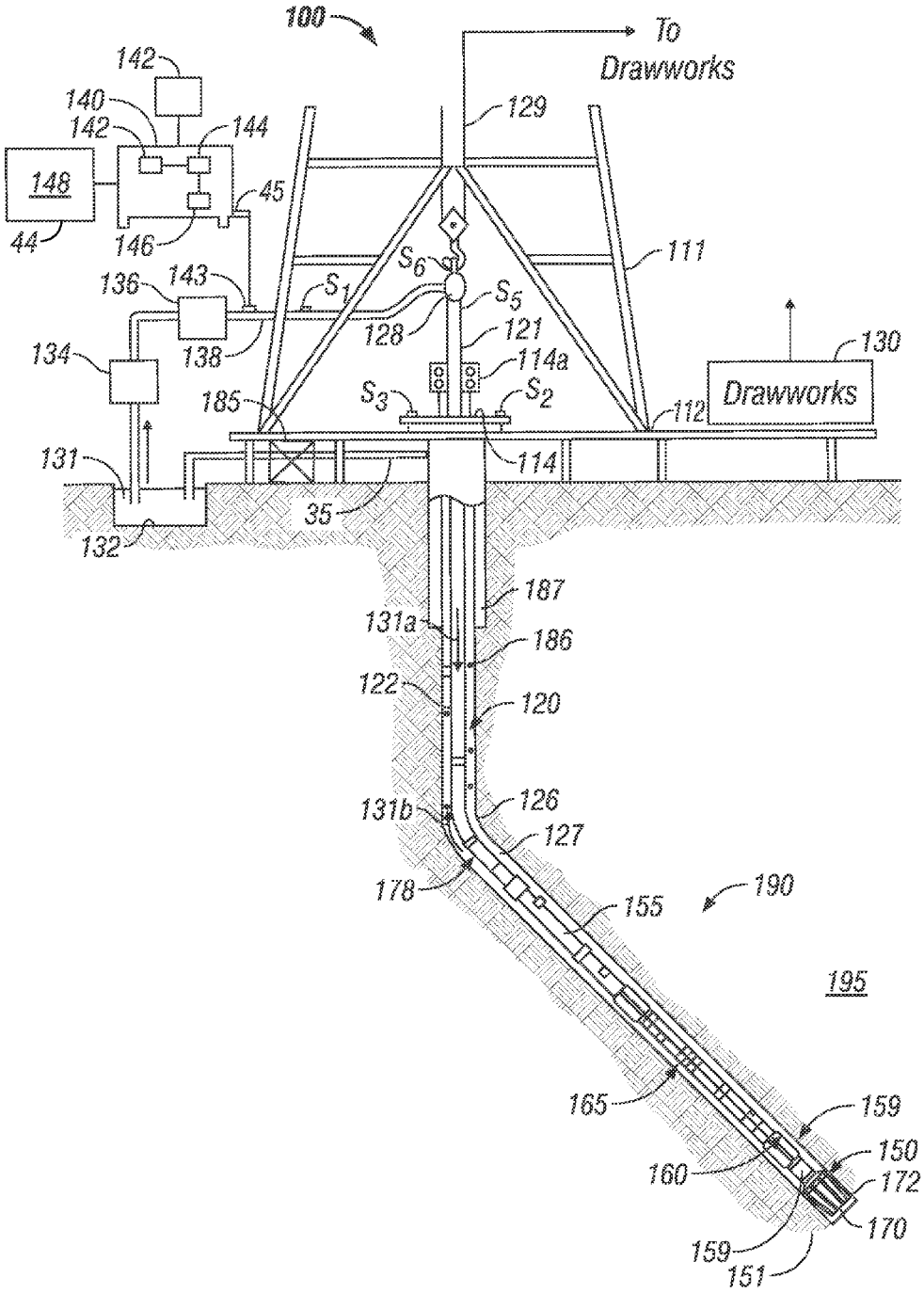
FIG. 1 is an elevation view of a drilling system including a downhole tool, according to an embodiment of the present disclosure.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottomhole assembly ("BHA") 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122, having the drilling assembly 190 attached at its bottom end extends from the surface to the bottom 151 of the borehole 126. A drill bit 150, attached to drilling assembly 190, disintegrates the geological formations when it is rotated to drill the borehole 126. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. The operations of the drawworks 130 are known in the art and are thus not described in detail herein.

In an aspect, a suitable drilling fluid 131 (also referred to as "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Rate of penetration of the drill string 120 may be determined from the sensor $S_5$, while the sensor $S_6$ may provide the hook load of the drill string 120.

In some applications, the drill bit 150 is rotated by only rotating the drill pipe 122. However, in other applications, a downhole motor 155 (mud motor) disposed in the drilling assembly 190 also rotates the drill bit 150. The rate of penetration ("ROP") for a given drill bit and BHA largely depends on the WOB or the thrust force on the drill bit 150 and its rotational speed.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided from a program to the surface control unit 140. The surface control unit 140 displays desired drilling parameters and other information on a display/monitor 142 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole and may control one or more operations of the downhole and surface devices.

The drilling assembly 190 also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, corrosive properties of the fluids or formation downhole, salt or saline content, and other selected properties of the formation 195 surrounding the drilling assembly 190. Such sensors are generally known in the art and for convenience are generally denoted herein by numeral 165. The drilling assembly 190 may further include a variety of other sensors and devices 159 for determining one or more properties of the drilling assembly (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc. For convenience, all such sensors are denoted by numeral 159.

Still referring to FIG. 1, the drill bit 150 further includes a center bit 170 and outer bit 172. In an aspect, the center bit 170 rotates at a first speed while the outer bit 172 rotates at a second speed. The first and second speeds can vary with respect to one another or may be the same speed. The first and second speeds are configured to adjust and control a resultant side force in the drill bit 150, where the resultant side force controls a drilling and steering direction of the bit 150, BHA and drilling assembly 190. Certain exemplary embodiments of the drill bit 150 are described below in reference to FIGS. 2-5 below.

Figure 2A:
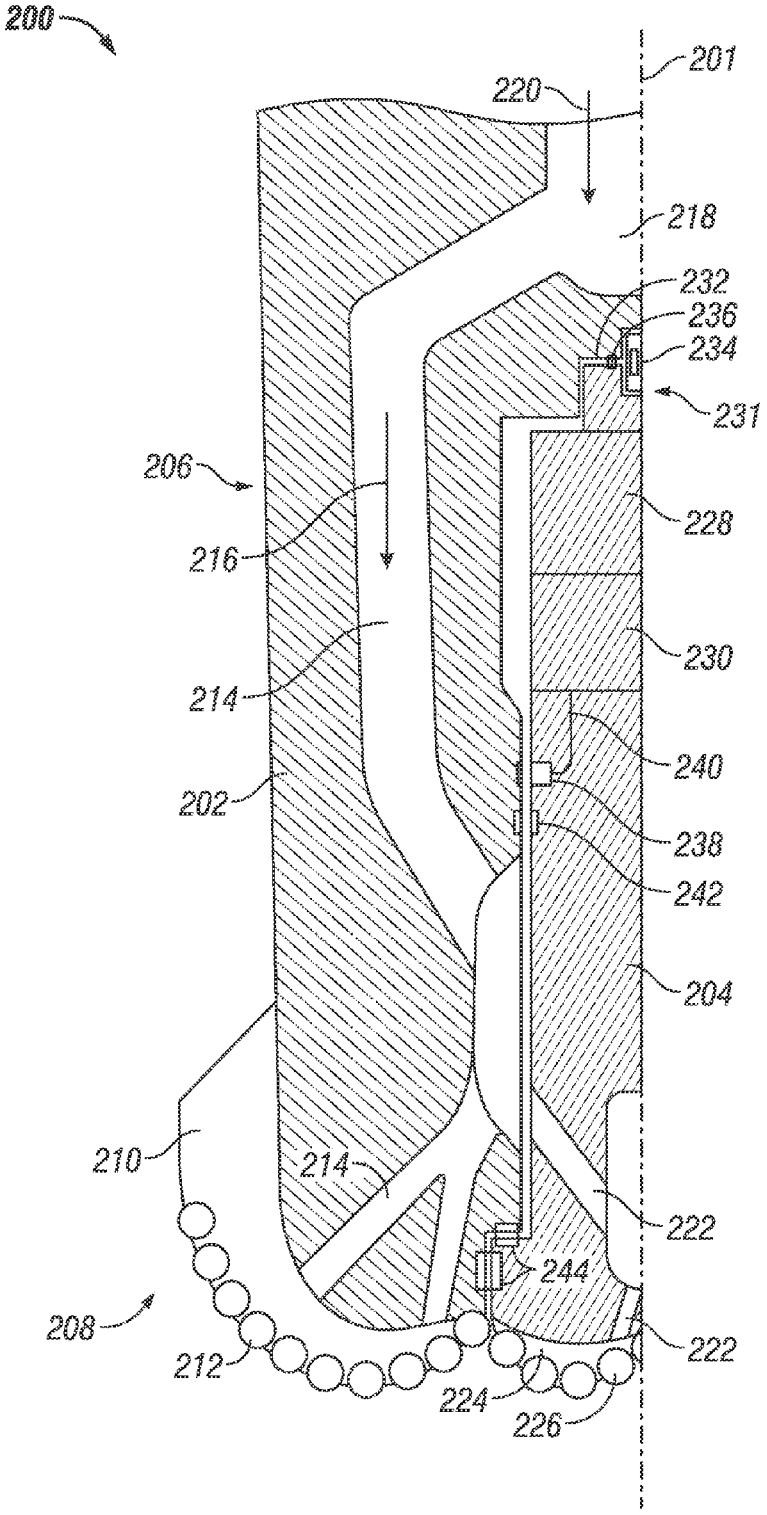
FIG. 2A is a sectional side view of a portion of a drill bit, according to an embodiment of the present disclosure.

FIG. 2 is a sectional side view of an embodiment of a drill bit 200. Half of the drill bit 200 is illustrated, wherein a centerline 201 runs through a center of the drill bit. The drill bit 200 comprises an outer bit 202 (or "outer member") and center bit 204 (or "center member" or "inner bit"). In an embodiment, the drill bit 200 includes a shank portion 206 located uphole of a cone portion 208. An outer cutter section 210 is located on outer bit 202. Waterways 214 provide a flow path for drilling fluid or mud to flow 216 along the outer bit 202 to the outer cutter section 210. In one embodiment, the drilling mud is supplied to a center cavity or flow channel 218 from the drill string and/or BHA, as indicated by arrow 220.

Similarly, drilling mud is directed to waterways 222 located in center bit 204. The waterways 222 direct the mud to center cutter section 224, where the center cutter section 224 comprises center cutters 226, such as fixed PDC cutters. The center bit 204 also includes a power unit, such as motor 228 and electronics 230, where the motor 228 and electronics 230 are configured to power and control a speed of rotation (or revolutions per minute or "RPM") of the center bit 204. The motor 228 is connected to connecting member 231, which comprises a fixed connection 232, electrical connection 234 and rotational decoupling 236. The fixed connection 232 and electrical connection provide physical and electrical connections between the outer bit 202 and center bit 204. For example, electrical, fluid and control lines from the BHA and drill string may be routed to the center bit via the fixed connection 232 and electrical connection. The rotational decoupling 236 includes a suitable mechanism, such as bearings, to enable relative rotation of the outer bit 202 and center bit 204. Further, a suitable electrical connection, such as an inductive coupling or conductive rings, may route electrical signals from the outer bit 202 to the inner bit 204. As depicted, an electrical line 240 provides a link for signals between a position sensor 238 and electronics 230. The position sensor 238 indicates a relative position and movement of the center bit 204 to the outer bit 202. A mechanism that allows relative movement, such as bearings (indicated by elements 242 and 244) provides a coupling and support while enabling the center bit 204 and outer bit 202 to rotate at different speeds.

Figure 3:
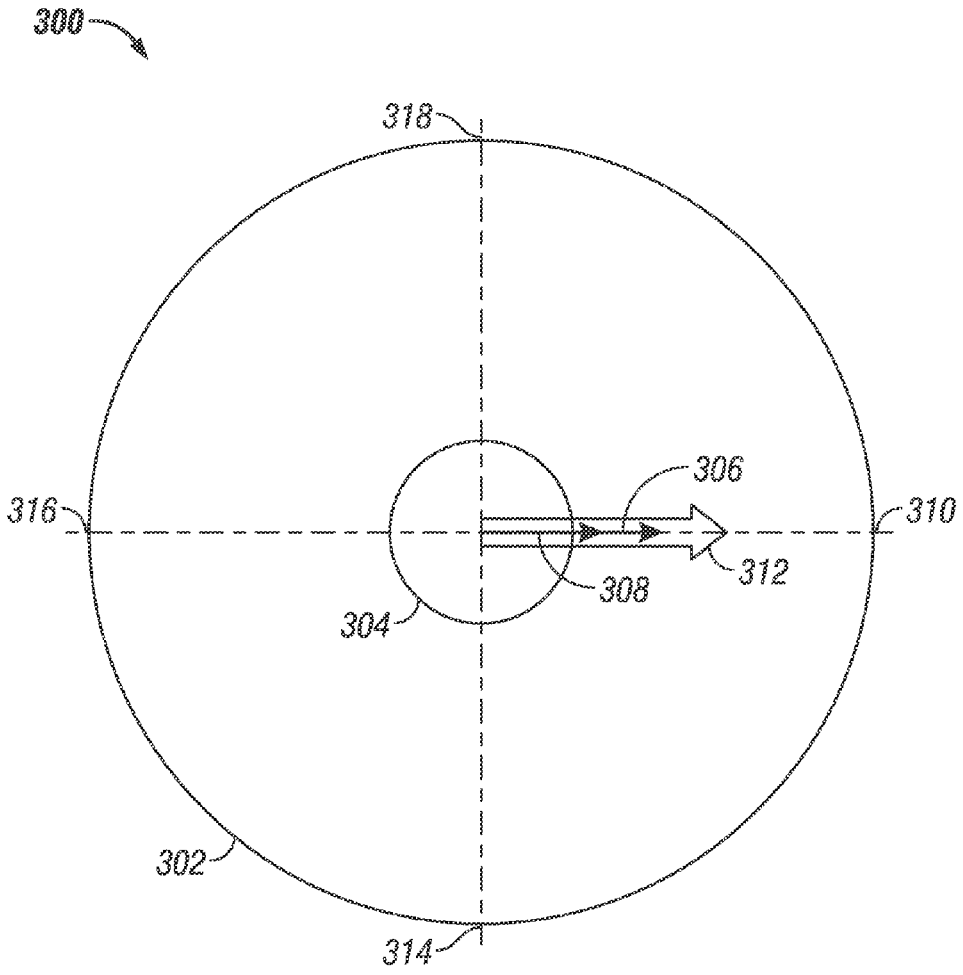
FIG. 3 is a schematic end view diagram of an embodiment of a drill bit, according to an embodiment of the present disclosure.
Figure 4:
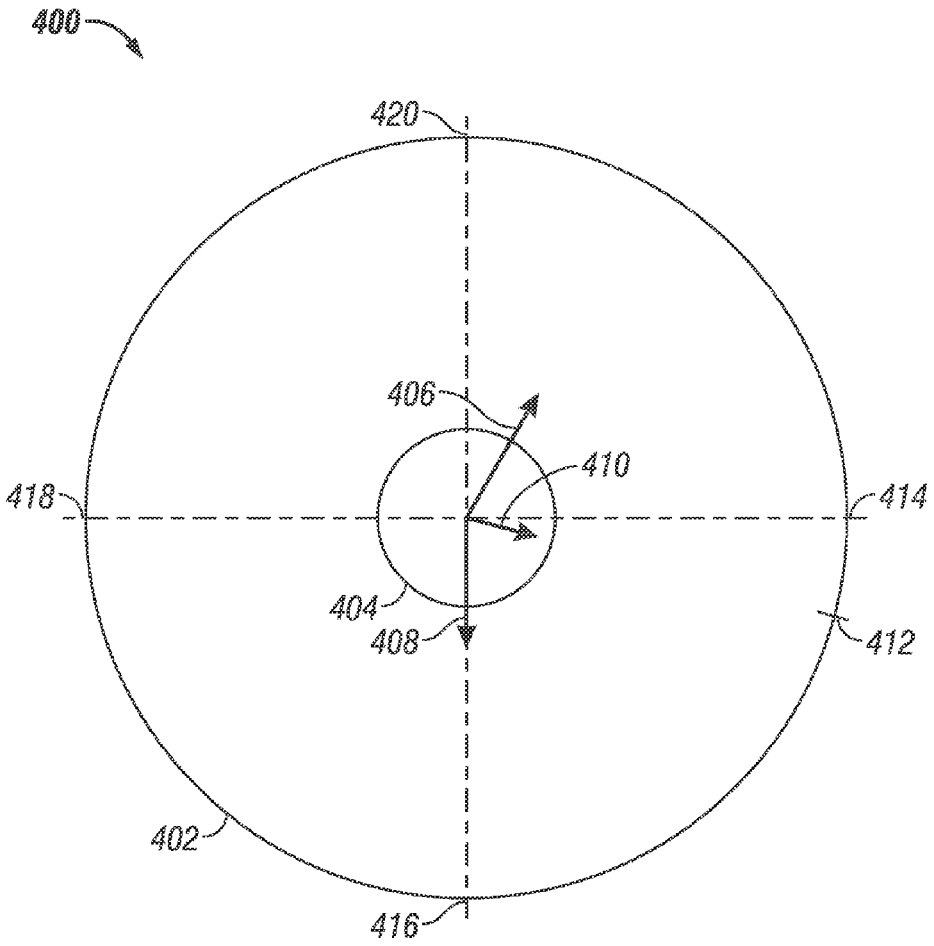
FIG. 4 is a schematic end view diagram of an embodiment of a drill bit, according to another embodiment of the present disclosure.
Figure 5:
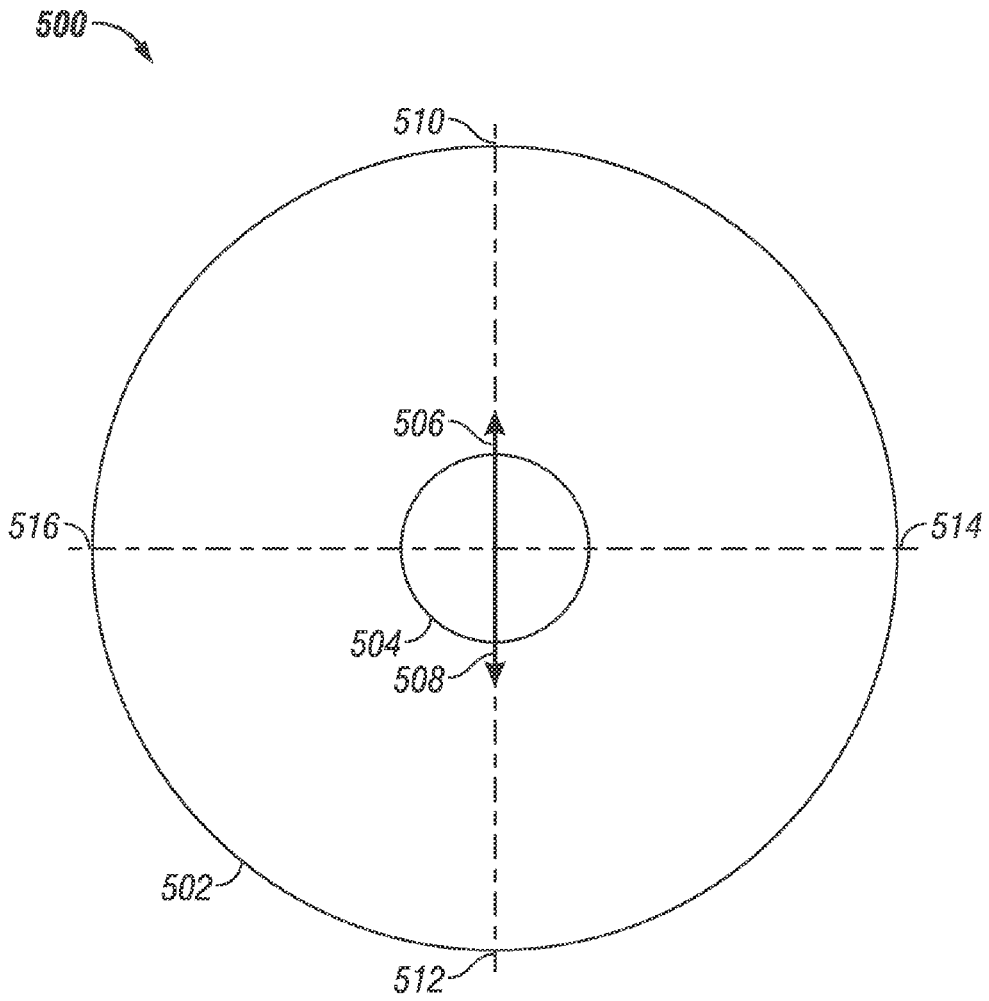
FIG. 5 is a schematic end view diagram of an embodiment of a drill bit, according to yet another embodiment of the present disclosure.

The illustrated drill bit 200 provides control over a steering direction for the bit and drill string by controlling the rotational speeds (RPMs) of the outer bit 202 and inner bit 204. In an embodiment, the outer bit 202 is designed with a selected amount of rotational imbalance, causing a resultant side force in a selected radial direction as the outer bit 202 is rotated. This force from the outer bit 202 may be described as a side force or steering force, where the side force urges the bit in a selected direction. Similarly, the center bit 204 is designed with a selected amount of rotational imbalance, causing a resultant side force in a selected radial direction as the center bit 204 is rotated. In the depicted arrangement, the drill bit 200 and selected electronics, controllers and motors may control and power the speed for the center bit 204 and outer bit 202. Accordingly, the rotation of each bit (202, 204) may be separately powered and controlled. Further, the center bit 204 rotation and corresponding side force is in a first direction and the outer bit 202 and corresponding side force is in a second direction. By controlling the speed of the center and outer bit, the combined resultant force (or total force) of the center bit 204 side force and the outer bit 202 side force urges the drill bit 200 and drill string in a selected third direction. FIGS. 3-5 schematically illustrate examples of the bit forces and the combined resultant forces in detail.

Figure 2B:
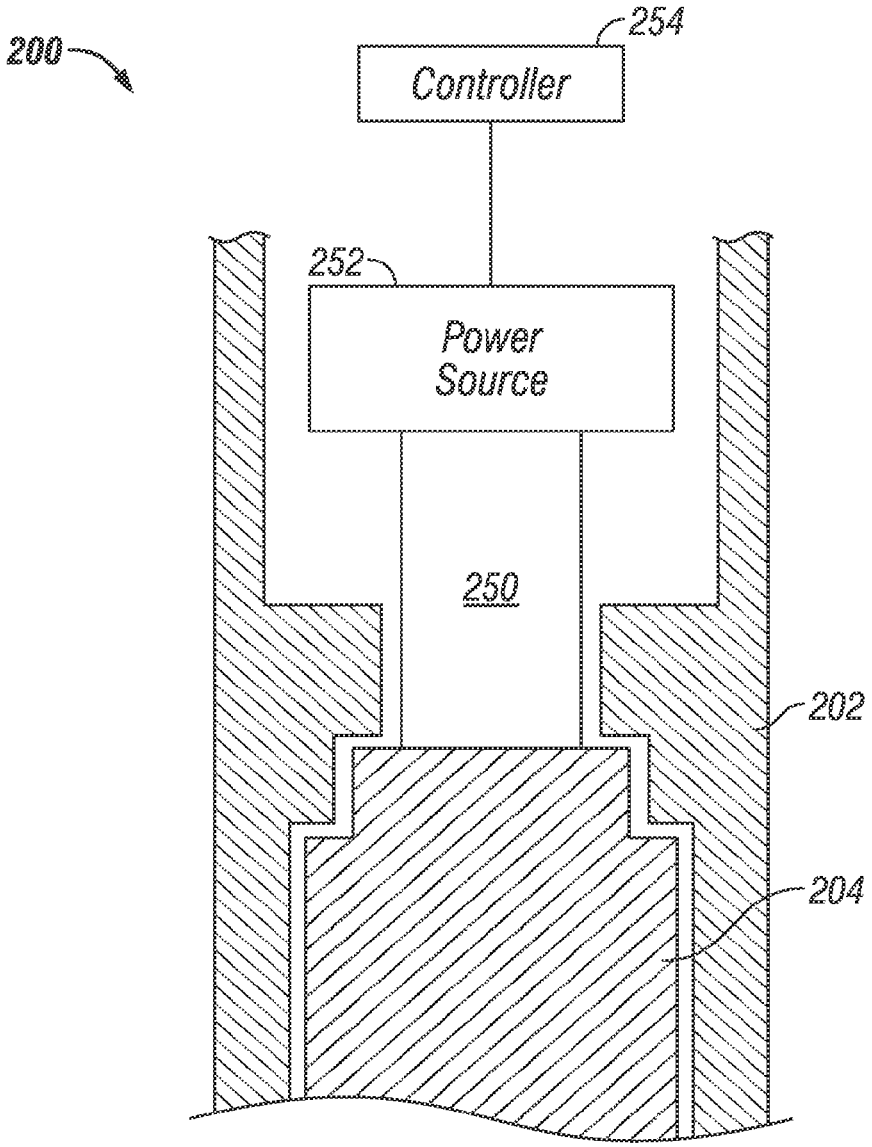
FIG. 2B is a sectional side view of a portion of a drill bit, according to an embodiment of the present disclosure.
Figure 2C:
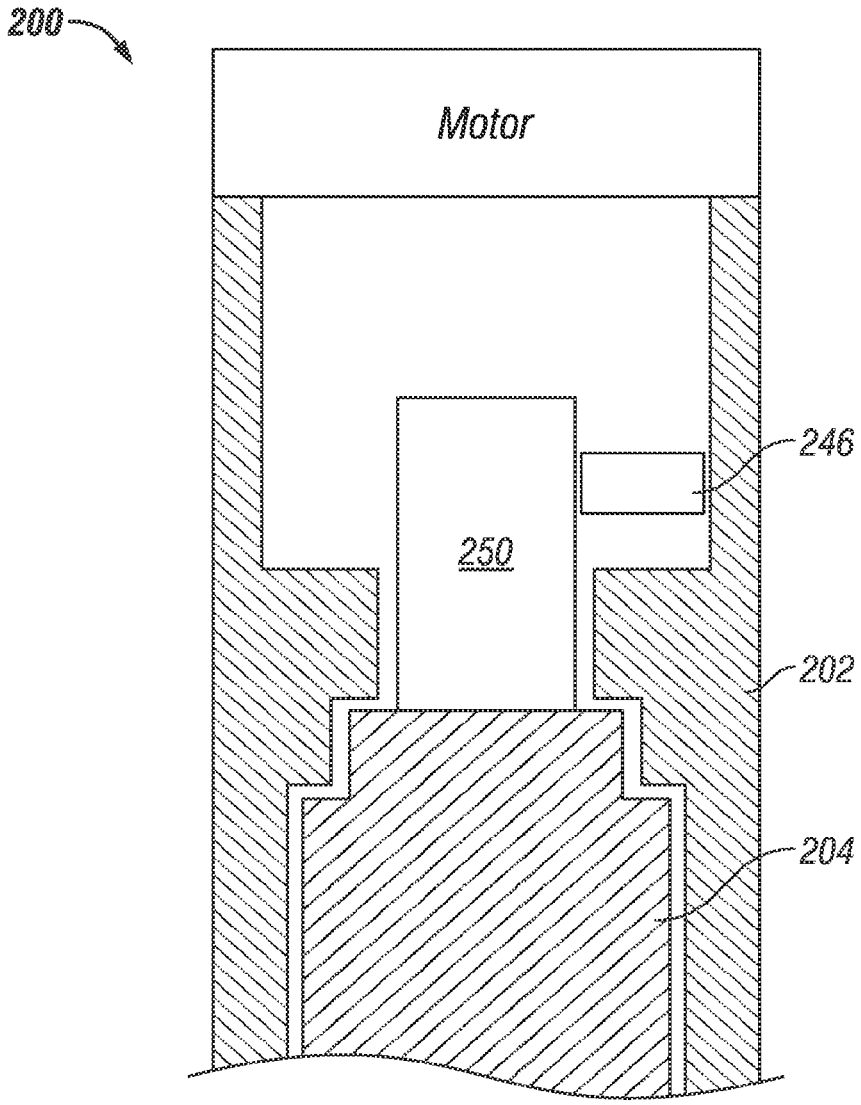
FIG. 2C is a sectional side view of a portion of a drill bit, according to an alternate embodiment of the present disclosure.

With continued reference to FIG. 2, the relative rotational speeds of the center bit 204 and outer bit 202 may be dynamically controlled, where the speed of one or both of the center and outer bits (204, 202) is changed as the drill bit 200 forms the wellbore. In an aspect, the position sensor 238 is an optical or Hall-effect sensor used to determine the speed of the center bit 204 relative to the outer bit 202. Other sensors may also be located on or near the drill bit 200 to determine speed relative to the formation, temperature, pressure or other drilling parameters. Controllers, processors, software, hardware, memory and other electronics, located downhole and/or at the surface, are configured to actively or dynamically control the speeds of the outer and center bits (202, 204) to control the resultant side force and the corresponding steering direction of the drill bit 200. One or more suitable motors may be used to power the rotation of the outer bit 202 and center bit 204. For example, a mud motor may power rotation of the outer bit 202 while an electric motor powers the center bit 204. In another embodiment, a single mud motor powers both the outer bit 202 and the center bit 204, where a gear mechanism 246 with an adjustable gear ratio adjusts the speed of the outer bit 202 relative to the center bit 204. (See FIG. 2C) In embodiments, the center bit 204 and outer bit 202 may be the same type of wellbore-forming bits (or members) or may be different types of bits, such as PDCs, fixed cutters, roller cones, reamers or any other suitable drill bit. As depicted, drill bit 200 provides improved control over steering with fewer components to reduce maintenance. In addition, the drill bit 200 may also lead to improved rates of penetration (ROP) in the wellbore, thereby improving drilling efficiency. For example, an ROP for the bit 200 may increase when the center bit 204 rotates at a higher rate than the outer bit 202. Thus, the depicted drill bit 200 improves efficiency while reducing downtime and maintenance. In addition, one of the outer or center bits (202, 204) may be oriented from 0-180° in relation to the other to create a rotating side force for increased stability during drilling.

FIG. 2B is a sectional side view of an embodiment of a portion of bit 200. The bit 200 includes an outer bit 202 and center bit 204. The center bit 204 is coupled to a shaft 250 which is configured to transfer rotational movement and force to the center bit 204. A power source 252 is coupled to the shaft 250, thereby powering rotation of the shaft 250 and center bit 204. A controller 254 is operable coupled to the power source 252 to control the speed of center bit 204 rotation. The power source 252 may be any suitable device to create rotational force, such as a mud motor or electric motor. The controller 254 may include a processor and memory accessible to at least one software or firmware program to control a speed and operation of the center bit 204. The controller 254 may be located downhole and/or at the wellbore surface. In an aspect, the center bit 204 is rotated by the power source 252 while the outer bit 202 is rotated by a second power source, such as by rotation of the tubular at the surface.

FIG. 3 is a schematic end view diagram of an embodiment of a drill bit 300. The drill bit 300 includes an outer bit 302 and a center bit 304. As discussed above, the outer bit 302 has a rotational imbalance that causes an outer bit side force 306. The center bit 304 also has a rotational imbalance and corresponding center bit side force 308. As depicted, the outer bit side force 306 and center bit side force 308 are both configured to urge or direct the bit 300 in a selected direction 310, which may also be referred to as a 3 o'clock direction (referring to corresponding locations on a clock face). As discussed herein, the directional positions of the bit are referred to as 3 o'clock direction 310, 6 o'clock direction 314, 9 o'clock direction 316 and 12 o'clock direction 318. Accordingly, the combined resultant force 312 is also directed in the selected direction 310. The rotational speed of the outer bit 302 and center bit 304 can be dynamically controlled and adjusted relative to one another to control a steering direction of the drill bit 300. In one example, the center bit 304 is rotated at a speed that is about 2 times the rotational speed of the outer bit 302, thereby causing the side forces of each bit to form a combined resultant force and steer the bit 300 in a selected direction, such as 12 o'clock direction 318. The steering and drilling direction of the drill bit 300 is controlled by changing the rotational speed (or RPMs) of one or both of the center and outer bits (302, 304) so that the resultant rotational side force vector points to 12 o'clock. As depicted, rotating the center bit 304 and the outer bit 302 with the same RPM provides a fixed imbalance force (side force) 312 that can be the highest, lowest or any other value between the lowest and the highest side force values.

FIG. 4 is a schematic end view diagram of an embodiment of a drill bit 400. The drill bit 400 includes an outer bit 402 and a center bit 404. In an embodiment, the outer bit 402 has an imbalance during rotation that causes an outer bit side force 406. The center bit 404 also has a rotational imbalance and corresponding center bit side force 408. As depicted, the outer bit side force 406 and center bit side force 408 are combined to form a resultant force 410, which urges the drill bit 400 in a selected direction 412. The directional positions of the bit are referred to as 3 o'clock direction 414, 6 o'clock direction 416, 9 o'clock direction 418 and 12 o'clock direction 420. The speeds of the center and outer bits (404, 402) are adjusted to control a corresponding side force for each, and the resultant combined force, thereby enabling control of the steering direction of the drill bit 400 by manipulating the rotational imbalance of the bits (404, 402). In the depicted example, to adjust the steering direction with respect to the borehole, the RPM ratio between center bit 404 and outer bit 402 is changed to slightly greater than two or slightly less than two and is exactly two again after the selected direction is adjusted. Thus, side forces 406 and 408 indicate an RPM ratio of slightly less than two or slightly greater than two, thereby allowing an adjustment of steering direction. When the inner bit is rotated at the same rotational speed as the outer bit, the resultant side force vector can be adjusted between a maximum or minimum (zero) resultant rotational side force vector, thus operating the center and outer bit combination in an ant-whirl mode.

FIG. 5 is a schematic end view diagram of an embodiment of a drill bit 500. The drill bit 500 includes an outer bit 502 and a center bit 504. In an embodiment, the outer bit 502 has an imbalance during rotation that causes an outer bit side force 506. The center bit 504 also has a rotational imbalance and corresponding center bit side force 508. The outer bit side force 506 is in a 12 o'clock direction 510 and the center bit side force 512 is in a 6 o'clock direction 512. Further, the directional positions of the bit are referred to as 3 o'clock direction 514, 6 o'clock direction 512, 9 o'clock direction 516 and 12 o'clock direction 510. In an aspect, the center bit 504 may be rotated at the same speed or RPM of the outer bit 502, to cause the rotational side force vectors to be 180 degrees apart. As depicted, the outer bit side force 506 and center bit side force 508 are combined to cause a minimum side force, such as zero force, when the bit 500 is drilling in a desired direction. Accordingly, FIG. 3 illustrates a substantially high side force, FIG. 5 shows a substantially zero side force and FIG. 4 shows a side force between those of FIGS. 3 and 5. Further, the amount of adjusted side force may change the bit and BHA behavior, such as reducing vibrations or whirl, while delivering improved ROP if the center bit is rotated at the same rotational speed as the outer bit.

A drilling apparatus that includes a drill bit made according to this disclosure may be utilized to drill a wellbore in various modes, including, but not limited to, a steering mode and a non-steering mode. In the steering mode, for example, the inner bit may be rotated at twice the speed of the outer bit (2:1 ratio). In this example, the resultant side force changes from a maximum (largest) to minimum (least) and back to maximum. In this example, the drilling assembly will steer to a particular direction, for example 12 o'clock direction. To change the direction of the maximum resultant force from 12 o'clock direction to another direction, the ratio 2:1 may be changed, as desired, to a higher or lower value for a selected time period and then changed back to 2:1 ratio so as to maintain the drilling direction along the new adjusted direction. In a drilling mode (non-steering), the rotational speed ratio may be kept at 1:1 so as to maintain a constant resultant side force (maximum, minimum or a side force between the maximum and minimum side forces). In this mode, the adjusted resultant constant side force (maximum, minimum or one in between) rotates with the drill bit and thus with the drilling assembly.

Thus, in one aspect drilling apparatus is provide that includes a drill bit that in one embodiment may include a center member including a first cutter configured to rotate at a first speed, an outer member including a second cutter disposed outside the center member configured to rotate at a second speed; and wherein the first speed and second speed cooperate to control a resultant side force on the outer member to control a drilling direction. In one aspect, the first speed may be equal to the second speed. In another aspect, the second speed may be two times the first speed. In another aspect one speed may be half the other speed. The first cutter and second cutter may be any suitable cutters, including, but not limited to, polycrystalline diamond compact cutters and roller cones. In a particular configuration, the drill bit includes a cone and a shank wherein the center member is disposed inside the outer member in both the cone and shank. In another aspect, the drill bit further includes a side force member disposed at the cone of the drill bit or shank of the drill bit. In aspects, during drilling, the first cutter contacts a formation at a face of the drill bit and the second cutter contacts the formation at a side and the face of the drill bit. In another aspect, the drill bit further includes power unit, such as a motor configured to rotate the outer member. An adjustable gear mechanism coupled to the motor may be utilized to provide power for rotation of the center bit.

In another aspect, a method for making a drill bit is provided, which method, in one embodiment includes: providing a center bit configured to rotate at a first speed; and providing an outer bit disposed outside the center bit, wherein the outer bit is configured to rotate at a second speed, and wherein the first speed and second speed are configured to control a resultant side force on the drill bit during drilling of a formation. The cutters may be of any suitable type including PDC cutters and roller cones. The method may further include providing a power unit configured to rotate the outer bit. The method may further include providing an adjustable gear mechanism coupled to the power unit to provide power for the rotation of the center bit.

In yet another aspect, the disclosure provides a method of drilling wellbore. An embodiment of the method includes conveying a drill string in the wellbore that includes a drill bit having first drill bit in a second drill bit; drilling the wellbore by rotating the first drill bit at a speed that differs from the rotational speed of the second drill bit. In one aspect, the method further includes rotating the first drill bit a speed that is about two times the rotational speed of the second drill bit. In aspects, during drilling the first drill bit provides a first side force during drilling of the wellbore and the second drill bit provides a second side force during drilling of the wellbore and a resultant side force that is a combination of the first side force and the second side force and wherein the method further include altering the rotational speed of the first drill bit during drilling of the wellbore to alter magnitude and/or direction of the resultant side force.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

The invention claimed is:

1. A drill bit, comprising:

a center member having a first rotational imbalance and configured to rotate at a first speed to cause a first side force resulting from the first rotational imbalance;

an outer member disposed outside the center member, wherein the outer member has a second rotational imbalance and is configured to rotate at a second speed to cause a second side force resulting from the second rotational imbalance; and a gear mechanism with an adjustable gear ratio configured to provide power from the outer member to the center member to rotate the center member at the second speed, wherein the first speed and the second speed provided by the gear mechanism combine to provide a resultant side force that controls a drilling direction of the drill bit, and the adjustable gear ratio is adjusted during formation of a wellbore.

2. The drill bit of claim 1, wherein the first speed is equal to the second speed.

3. The drill bit of claim 1, further comprising a first cutter disposed on the center member and a second cutter disposed on the outer member, wherein the first cutter and second cutter comprise one of: polycrystalline diamond compact cutters and roller cones.

4. The drill bit of claim 1, wherein the center member is disposed inside a cone portion of the outer member and a shank portion of the outer member.

5. The drill bit of claim 1, further comprising a first cutter disposed on the center member and a second cutter disposed on the outer member, wherein the first cutter is on a cone portion of the center member and the second cutter is on a cone portion of the outer member.

6. The drill bit of claim 1, further comprising a side force member disposed on one selected from the group consisting of: a cone and shank.

7. The drill bit of claim 1, further comprising a first cutter disposed on the center member and a second cutter disposed on the outer member, wherein the first cutter contacts a formation at a central portion of the drill bit and the second cutter contacts the formation at a cone portion of the drill bit.

8. A method for making a drill bit, comprising:

providing a center bit having a first rotational imbalance and configured to rotate at a first speed to provide a first side force resulting from the first rotational imbalance; and providing an outer bit having a second rotational imbalance disposed outside the center bit, wherein the outer bit is configured to rotate at a second speed to provide a second side force resulting from the second rotational imbalance; and providing a gear mechanism with an adjustable gear ratio to provide power from the outer bit to the center bit to rotate the center bit at the second speed, wherein the first speed and the second speed provided by the gear mechanism combine to provide a resultant side force that controls a drilling direction of the drill bit, and the adjustable gear ratio is adjusted during formation of a wellbore.

9. The method of claim 8, wherein providing a center bit comprises providing polycrystalline diamond compact cutters on the center bit and wherein providing an outer bit comprises providing polycrystalline diamond compact cutters on the outer bit.

10. The method of claim 8, wherein providing a center bit comprises providing roller cones on the center bit and wherein providing an outer bit comprises providing roller cones on the outer bit.

11. The method of claim 8, comprising providing a motor to power rotation of the outer bit.

12. An apparatus for use in drilling of a wellbore, comprising:

a drilling assembly that has a drill bit attached to an end thereof, the drill bit comprising:

a center bit having a first rotational imbalance and configured to rotate at a first speed to provide a first side force resulting from the first rotational imbalance; and an outer bit having a second rotational imbalance disposed outside the center bit, wherein the outer bit is configured to rotate at a second speed to provide a second side force resulting from the second rotational imbalance; and a gear mechanism with an adjustable gear ratio configured to provide power from the outer member to the center member to rotate the center member at the second speed, wherein the first speed and the second speed provided by the gear mechanism combine to provide a resultant side force that controls a drilling direction of the drill bit, and the adjustable gear ratio is adjusted during formation of a wellbore.

13. The apparatus of claim 12, wherein the center bit contacts a formation at a central portion of the drill bit and the outer bit contacts the formation at a cone portion of the drill bit.

14. A method of drilling a wellbore, comprising:

conveying a drill string in the wellbore, the drill string including a drill bit including a first drill bit having a first rotational imbalance in a second drill bit having a second rotational imbalance; and drilling the wellbore by rotating the first drill bit at a speed that differs from the rotational speed of the second drill bit; and adjusting a rotational speed of the second drill bit using a gear mechanism with an adjustable gear ratio that provide power from the outer member to the center member to rotate the center member at the second speed, wherein the first speed and the second speed provided by the gear mechanism combine to provide a resultant side force that controls a drilling direction of the drill bit, and the adjustable gear ratio is adjusted during formation of a wellbore.

15. The method of claim 14, further comprising rotating the first drill bit at a rotational speed that is about two times the rotational speed of the second drill bit.

16. The method of claim 14, wherein rotating the first drill bit provides a first side force during drilling of the wellbore and rotating the second drill bit provides a second side force during drilling of the wellbore and a combination of the first side force and the second side force provides a resultant side force and wherein the method further comprises altering the rotational speed of the first drill bit during drilling of the wellbore to alter a magnitude of the resultant side force.

* * * * *